US009860656B2

(12) United States Patent
Jensen et al.

(10) Patent No.: US 9,860,656 B2
(45) Date of Patent: Jan. 2, 2018

(54) HEARING SYSTEM COMPRISING A SEPARATE MICROPHONE UNIT FOR PICKING UP A USERS OWN VOICE

(71) Applicant: Oticon A/S, Smørum (DK)

(72) Inventors: Jesper Jensen, Smørum (DK); Michael Syskind Pedersen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/042,248

(22) Filed: Feb. 12, 2016

(65) Prior Publication Data

US 2016/0241974 A1 Aug. 18, 2016

(30) Foreign Application Priority Data

Feb. 13, 2015 (EP) ..... 15154947

(51) Int. Cl.
*H04R 25/00* (2006.01)
*H04R 3/00* (2006.01)

(52) U.S. Cl.
CPC ..... *H04R 25/554* (2013.01); *H04R 25/407* (2013.01); *H04R 25/505* (2013.01); (Continued)

(58) Field of Classification Search
CPC .... H04R 3/005; H04R 25/405; H04R 25/407; H04R 25/554; H04R 2201/40; (Continued)

(56) References Cited

U.S. PATENT DOCUMENTS 7,738,666 B2 * 6/2010 Marquis ..... H04R 25/30 381/315
2008/0101635 A1 * 5/2008 Dijkstra ..... H04R 25/30 381/315

(Continued)

FOREIGN PATENT DOCUMENTS

EP 2 701 145 A1 2/2014
EP 2 835 986 A1 2/2015
WO WO 2014/055312 A1 4/2014

OTHER PUBLICATIONS

Kjems et al., "Maximum Likelihood Based Noise Covariance Matrix Estimation for Multi-Microphone Speech Enhancement," 20th European Signal Processing Conference (EUSIPCO 2012), Bucharest, Romania, Aug. 27-31, 2012, pp. 295-299.

*Primary Examiner* — Brian Ensey
(74) *Attorney, Agent, or Firm* — Birch, Stewart, Kolasch & Birch, LLP

(57) ABSTRACT

A hearing system for communication with a mobile telephone comprises a hearing device and a separate microphone unit adapted for picking up a voice of a user. The microphone unit comprises a) a multitude M≥2 of input units for picking up or receiving a signal representative of a sound from the environment; b) an adaptive multi-input unit noise reduction system for providing an estimate Ŝ of a target signal s comprising the user's voice, the multi-input unit noise reduction system comprises a multi-input beamformer filtering unit configured to determine filter weights w(k,m) for providing a beamformed signal, wherein signal components from other directions than a direction of a target signal source are attenuated, whereas signal components from the direction of the target signal source are left unattenuated; and c) antenna and transceiver circuitry for transmitting said estimate Ŝ of the user's voice to another device.

23 Claims, 5 Drawing Sheets

(52) U.S. Cl.
CPC ..... *H04R 3/005* (2013.01); *H04R 2201/40* (2013.01); *H04R 2225/51* (2013.01); *H04R 2225/55* (2013.01); *H04R 2420/07* (2013.01); *H04R 2430/23* (2013.01); *H04R 2460/01* (2013.01)

(58) Field of Classification Search
CPC ..... H04R 2225/43; H04R 2225/51; H04R 2225/55; H04R 2420/07; H04R 2430/23
See application file for complete search history.

(56) References Cited

U.S. PATENT DOCUMENTS

2014/0056435 A1* 2/2014 Kjems ..... H04M 9/082 381/317
2016/0073203 A1* 3/2016 Kuriger ..... H04R 25/43 381/23.1

* cited by examiner

HEARING SYSTEM COMPRISING A SEPARATE MICROPHONE UNIT FOR PICKING UP A USERS OWN VOICE

SUMMARY

The present application relates to a hearing system for use in connection with a telephone. The disclosure relates specifically to a hearing system comprising a hearing device adapted for being located at or in an ear of a user, or adapted for being fully or partially implanted in the head of the user, and a separate microphone unit adapted for being located at said user and picking up a voice of the user.

Embodiments of the disclosure may e.g. be useful in applications involving hearing aids, handsfree telephone systems, mobile telephones, teleconferencing systems, etc.

Instead of using a microphone system of a hearing device, a separate microphone unit may be used to allow communication between a hearing aid system and a mobile phone. Such additional microphone may be used in noisy or other acoustically challenging situations, e.g. in a car cabin situation. The microphone unit may comprise one or two or more microphones, processing capabilities, and wireless transmission capabilities. Such separate microphone unit may e.g. be worn around the neck in a way to provide a fixed orientation and a fixed distance to the mouth of the user.

In a basic use scenario of a separate microphone unit according to the present disclosure, the hearing device user attaches (e.g. clips) the microphone unit onto his or her own chest, the microphone(s) of the unit pick(s) up the voice signal of the user, and the voice signal is transmitted wirelessly via the mobile phone to the far-end listener. The microphone(s) of the microphone unit is/are placed close to the target source (the mouth of the user), so that a relatively noise-free target signal is made available to the mobile phone and a far-end listener. The situation is depicted in FIG. 1.

Compared to a situation where orientation and distance of the microphone unit relative to a user's mouth is fixed (e.g. when the microphone unit is worn around the neck), a 'clip-on' microphone unit in wireless communication with another device, e.g. a cellular telephone, has the advantage of increased flexibility in placement, but also the disadvantage of giving up on the fixed orientation and distance. The latter problem is solved by a microphone unit according to the present disclosure. The microphone unit of the present disclosure comprises two or more microphones. Even though the microphones of the microphone unit are located close to the user's mouth, the target-signal-to-noise ratio of the signal picked up by the microphones may still be less than desired. For that reason, a beamformer-noise reduction system may be employed in the microphone unit to retrieve the target voice signal from the noise background and in this way increase the signal to noise ratio (SNR), before the target voice signal is wirelessly transmitted to the other device, e.g. a mobile phone (e.g., placed in the pocket of the user) and onwards to a far-end listener. Any spatial noise reduction system works best if the position of the target source relative to the microphones is known. In hearing systems, the target signal is usually assumed to be in the frontal direction relative to the user of the hearing system (cf. e.g. LOOK DIR in FIG. 5), i.e., (roughly) in the direction of the microphone axis of a behind-the-ear hearing device (cf. e.g. REF-DIR$_L$, REF-DIR$_R$, of the left and right hearing devices in FIG. 5). In the current situation, however, the microphone axis of the microphone unit is not necessarily fixed: Firstly, the microphone unit may be attached casually so that it does not "point" directly to the user's mouth, and secondly, the microphone unit may be attached to a variable surface (e.g. clothes, e.g. on the chest) of the user, so that the position/direction of the microphone unit relative to the user's mouth may change over time (cf. e.g. FIG. 6*a*, 6B). A consequence of this is that the beamformer-noise reduction system works less well, and in worst cases, the SNR is decreased rather than increased.

In an aspect of the present disclosure, it is proposed to use an adaptive beamformer-noise reduction system in the microphone unit to reduce the ambient noise level and retrieve the users' speech signal, before the noise-reduced voice signal is wirelessly transmitted via the hearing device users' mobile phone to a far-end listener.

The technical solution of this task is generally difficult, but in this particular situation it is made slightly easier by the fact that in a phone conversation, it is easy to detect in the microphone unit, when the hearing device user is speaking and when he or she is quiet; this latter point allows the proposed noise reduction system to estimate the (generally time-varying) noise power spectral density of the disturbing background noise and afterwards reduce it more efficiently.

An object of the present application is provide an improved hearing system.

Objects of the application are achieved by the invention described in the accompanying claims and as described in the following.

A Hearing System:

In an aspect of the present application, an object of the application is achieved by a hearing system comprising a hearing device, e.g. a hearing aid, adapted for being located at or in an ear of a user, or adapted for being fully or partially implanted in the head of the user, and a separate microphone unit adapted for being located at said user and picking up a voice of the user, wherein the microphone unit comprises

- a multitude M of input units IUi, i=1, 2, . . . , M, each being configured for picking up or receiving a signal representative of a sound $x_i(n)$ from the environment of the microphone unit and configured to provide corresponding electric input signals $X_i(k,m)$ in a time-frequency representation in a number of frequency bands and a number of time instances, k being a frequency band index, m being a time index, n representing time, and M being larger than or equal to two; and
- a multi-input unit noise reduction system for providing an estimate $\hat{S}$ of a target signal s comprising the user's voice, the multi-input unit noise reduction system comprises a multi-input beamformer filtering unit operationally coupled to said multitude of input units $IU_i$, i=1, . . . , M, and configured to determine filter weights w(k,m) for providing a beamformed signal, wherein signal components from other directions than a direction of a target signal source are attenuated, whereas signal components from the direction of the target signal source are left un-attenuated or are attenuated less relative to signal components from said other directions; and
- antenna and transceiver circuitry for transmitting said estimate $\hat{S}$ of the user's voice to another device wherein the multi-input beamformer filtering unit is adaptive.

An advantage of the hearing system is that it facilitates communication between a wearer of a hearing device and another person via a telephone.

In an embodiment, at least some of the multitude of input units comprises an input transducer, such as a microphone for converting a sound to an electric input signal. In an embodiment, at least some of the multitude of input units comprise a receiver (e.g. a wired or wireless receiver) for directly receiving an electric input signal representative of a sound from the environment of the microphone unit.

In an embodiment, 'another device' comprises a communication device. In an embodiment, 'another device' in the meaning 'the other device' previously referred to and to which the microphone unit is adapted to transmit the estimate $\hat{S}$ of the user's voice comprises a communication device In an embodiment, the communication device comprises a cellular telephone, e.g. a SmartPhone. In an embodiment, the estimate $\hat{S}$ of the user's voice is intended to be transmitted to a far-end receiver via the cellular telephone connected to a switched telephone network, e.g. a local network or a public switched telephone network, PSTN, or the Internet or a combination thereof.

In an embodiment, the hearing device and the microphone unit each comprises respective antenna and transceiver circuitry for establishing a wireless audio link between them. In an embodiment, the hearing system is configured to transmit an audio signal from the microphone unit to the hearing device via the wireless audio link. In a scenario, where the microphone unit receives an audio signal from another device, e.g. a communication device, e.g. a telephone (e.g. a cellular telephone), such audio signal e.g. representing audio from a far-end talker (connected via a far-end telephone—via a network—to a near end telephone of the user). In such scenario (or mode of operation), the microphone unit is adapted to forward (e.g. relay) the audio signal from the other device to the hearing device(s) of the user.

In an embodiment, the microphone unit comprises a voice activity detector for estimating whether or not the user's voice is present or with which probability the user's voice is present in the current environment sound, or is configured to receive such estimates from another device (e.g. the hearing device or the other device, e.g. a telephone). In an embodiment, the voice activity detector provides an estimate of voice activity every time frame of the signal (e.g. for every value of the time index m). In an embodiment, the voice activity detector provides an estimate of voice activity for every time-frequency unit of the signal (e.g. for every value of the time index m and frequency index k, i.e. for every TF-unit (also termed TF-bin)). In an embodiment, the microphone unit comprises a voice activity detector for estimating whether or not the user's voice is present (or present with a certain probability) in the current electric input signals and/or in the estimate $\hat{S}$ of a target signal s. In an embodiment, the microphone unit comprises a voice activity detector for estimating whether or not a received audio signal from another device comprises a voice signal (or is present with a certain probability). In an embodiment, it is assumed that the user does not talk when a voice is detected in the received audio signal from the other device. In an embodiment, the hearing device comprises a hearing device voice activity detector. In an embodiment, another device, e.g. the hearing device, comprises a voice activity detector configured to provide an estimate of voice activity in the current environment sound. In an embodiment, the hearing system is configured to transmit the estimate of voice activity to the microphone unit from another device, e.g. from the hearing device.

In an embodiment, the hearing system, e.g. microphone unit, e.g. the multi-input unit noise reduction system, is configured to estimate a noise power spectral density of disturbing background noise when the user's voice is not present or is present with probability below a predefined level, or to receive such estimates from another device (e.g. the hearing device or the other device, e.g. a telephone). Preferably, the estimate of noise power spectral density is used to more efficiently reduce noise components in the noisy signal to provide an improved estimate of the target signal. In an embodiment, the multi-input unit noise reduction system is configured to update inter-input unit (e.g. inter-microphone) noise covariance matrices at different frequencies k (e.g. for K=16 bands) and a specific time m, when the user's voice is not present (i.e. when the user is silent) or is present with probability below a predefined level, e.g. below 30% or below 20%. In an embodiment, inter-input unit (e.g. inter-microphone) noise covariance matrices are updated with weights corresponding to the probability that the user's voice is NOT present. Thereby the shape of the beam pattern is adapted to provide maximum spatial noise reduction. Various aspects regarding the determination of covariance matrices are discussed in [Kjems and Jensen, 2012].

In an embodiment, the hearing system, e.g. the microphone unit, comprises a memory comprising a predefined reference look vector defining a spatial direction from the microphone unit to the target sound source. In an embodiment, the predefined (reference) look vector $d_{REF}$ is defined in an off-line procedure before use of the hearing system (for a number K of frequency bands, $d_{REF}=d_{REF}(k)$). Default beamformer weights (corresponding to the reference look vector) are e.g. determined in an offline calibration process conducted in a sound studio with a head-and-torso-simulator (HATS, Head and Torso Simulator 4128C from Brüel & Kjær Sound & Vibration Measurement A/S) with play-back of voice signals from the dummy head's mouth, and a microphone unit mounted in a default position on the "chest" of the dummy head. In an embodiment, the default beamformer weights are stored in the memory, e.g. together with the reference look vector. In this way, e.g., optimal minimum-variance distortion-less response (MVDR) beamformer weights may be found, which are hardwired, i.e. stored in memory, in the microphone unit.

In an embodiment, the multi-channel variable beamformer filtering unit comprises an MVDR filter providing filter weights $w_{mvdr}(k,m)$, said filter weights $w_{mvdr}(k,m)$ being based on a look vector d(k,m) and an inter-input unit covariance matrix $R_{vv}(k,m)$ for the noise signal.

In an embodiment, the multi-input unit noise reduction system is configured to adaptively estimate a current look vector d(k,m) of the beamformer filtering unit for a target signal originating from a target signal source located at a specific location relative to the user. In a preferred embodiment, the specific location relative to the user is the location of the user's mouth.

The look vector $\underline{d}(k,m)$ is an M-dimensional vector comprising elements (i=1, 2, . . . , M), the $i^{th}$ element $d_i(k,m)$ defining an acoustic transfer function from the target signal source (at a given location relative to the input units of the microphone unit) to the $i^{th}$ input unit (e.g. a microphone), or the relative acoustic transfer function from the $i^{th}$ input unit to a reference input unit. The vector element $d_i(k,m)$ is typically a complex number for a specific frequency (k) and time unit (m). The look vector d(k,m) may be estimated from the inter input unit covariance matrix $\hat{R}_{ss}(k,m)$ based on signals $s_i(k,m)$, i=1, 2, . . . , M from a signal source measured at the respective input units when the source is located at the given location.

In an embodiment, the multi-input unit noise reduction system is configured to update the look vector when the user's voice is present or present with a probability larger than a predefined value. The spatial direction of the beamformer, e.g. technically, represented by the so-called look-vector, is preferably updated when the user's voice is present or present with a probability larger than a predefined value, e.g. larger than 70% or larger than 80%. This adaptation is intended to compensate for a variation in the position of the microphone unit (across time and from user to user) and for differences in physical characteristics (e.g., head and shoulder characteristics) of the user of the microphone unit. The look-vector is preferably updated when the target signal to noise ratio is relatively high, e.g. larger than a predefined value.

In an embodiment, the hearing system is configured to limit said update of the look vector by comparing the update beamformer weights corresponding to an update look vector with the default weights corresponding to the reference look vector, and to constrain or neglect the update beamformer weights if these differ from the default weights with more than a predefined absolute or relative amount.

In an embodiment, the hearing system, e.g. the microphone unit, comprises a memory comprising predefined inter-input unit noise covariance matrices of the (input units of the) microphone unit. Preferably, the microphone unit is located as intended relative to a target sound source and a typical (expected) noise source/distribution is applied, e.g. an isotropically distributed (diffuse) noise, during determination of the predefined inter-input unit (e.g. inter-microphone) noise covariance matrices. In an embodiment, predefined inter-input unit (e.g. inter-microphone) noise covariance matrices are determined in an off-line procedure before use of the microphone unit, preferably conducted in a sound studio with a head-and-torso-simulator (HATS, Head and Torso Simulator 4128C from Brüel & Kjær Sound & Vibration Measurement A/S).

In an embodiment, the input units of the microphone unit comprise, such as consist of, microphones. In an embodiment, the hearing system is configured to control the update of the noise power spectral density of disturbing background noise by comparing currently determined inter-input unit (e.g. inter-microphone) noise covariance matrices with the reference inter-input unit (e.g. inter-microphone) noise covariance matrices, and to constrain or neglect the update of the noise power spectral density of disturbing background noise if the currently determined inter-input unit (e.g. inter-microphone) noise covariance matrices differ from the reference inter-input unit (e.g. inter-microphone) noise covariance matrices by more than a predefined absolute or relative amount. Thereby the adaptation of the beamformer is restrained from 'running away' in an uncontrolled manner.

In an embodiment, the multi-channel noise reduction system comprises a single channel noise reduction unit operationally coupled to the beamformer filtering unit and configured for reducing residual noise in the beamformed signal and providing the estimate $\hat{S}$ of the target signal s. An aim of the single channel post filtering process is to suppress noise components from the target direction (which has not been suppressed by the spatial filtering process (e.g. an MVDR beamforming process). It is a further aim to suppress noise components during which the target signal is present or dominant as well as when the target signal is absent. In an embodiment, the single channel post filtering process is based on an estimate of a target signal to noise ratio for each time-frequency tile (m,k). In an embodiment, the estimate of the target signal to noise ratio for each time-frequency tile (m,k) is determined from the beamformed signal and a target-cancelled signal.

In an embodiment, the microphone unit comprises at least three input units, wherein at least two of the input units each comprises a microphone, and wherein at least one of the input units comprises a receiver for directly receiving an electric input signal representative of a sound from the environment of the microphone unit. In an embodiment, the receiver is a wireless receiver. In an embodiment, the electric input signal representative of a sound from the environment of the microphone unit is transmitted by the hearing device and is picked up by a microphone of the hearing device. In an embodiment, the hearing system comprises two hearing devices, e.g. a left and right hearing device of a binaural hearing system. In an embodiment, the microphone unit comprises at least two input units, each comprising a (e.g. wireless) receiver for directly receiving an electric input signal representative of a sound from the environment of the microphone unit. In an embodiment, the hearing system is configured to transmit a signal picked up by a microphone of each of the left and right hearing device to receivers of respective input units of the microphone unit. Thereby, the multi-input noise reduction system is provided with inputs from at least two microphones located in the microphone unit and microphones located in separate other devices here in one or two hearing devices located at left and/or right ears of the user. This has the advantage of improving the quality of the estimate of the target signal (the user's own voice).

In an embodiment, the microphone unit is configured to receive an audio signal and/or an information signal from the other device. In an embodiment, the microphone unit is configured to receive an information signal, e.g. a status signal of a sensor or detector, e.g. an estimate of voice activity from a voice activity detector, from the other device. In an embodiment, the microphone unit is configured to receive an estimate of voice activity from a voice activity detector, from a cellular telephone, e.g. a SmartPhone.

In an embodiment, the microphone unit is configured to receive an estimate of far-end voice activity from a voice activity detector located in another device, e.g. in the other device, e.g. a communication device, or in the hearing device. In an embodiment, the estimate of far-end voice activity is generated in and transmitted from a communication device, e.g. a cellular telephone, such as a SmartPhone.

In an embodiment, the hearing system comprises two hearing devices implementing a binaural hearing system. In an embodiment, the hearing system further comprises an auxiliary device, e.g. a communication device, such as a telephone. In an embodiment, the system is adapted to establish a communication link between the hearing device and the auxiliary device to provide that information (e.g. control and status signals, possibly audio signals) can be exchanged or forwarded from one to the other, in particular from the auxiliary device (e.g. a telephone) to the hearing device(s).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input transducer for converting an input sound to an electric input signal. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device and/or the microphone unit comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device (e.g. a telephone) or another hearing device. In an embodiment, the direct electric input signal represents or comprises an audio signal and/or a control signal and/or an information signal. In an embodiment, the hearing device and/or the microphone unit comprises demodulation circuitry for demodulating the received direct electric input to provide the direct electric input signal representing an audio signal and/or a control signal e.g. for setting an operational parameter (e.g. volume) and/or a processing parameter of the hearing device. In general, the wireless link established by a transmitter and antenna and transceiver circuitry of the hearing device can be of any type. In an embodiment, the wireless link is used under power constraints. In an embodiment, the wireless link is a link based on near-field communication, e.g. an inductive link based on an inductive coupling between antenna coils of transmitter and receiver parts. In another embodiment, the wireless link is based on far-field, electromagnetic radiation.

Preferably, frequencies used to establish a communication link between the hearing device and the microphone unit and/or other devices is below 70 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device and the microphone unit are portable device, e.g. devices comprising a local energy source, e.g. a battery, e.g. a rechargeable battery.

In an embodiment, the hearing device and/or the microphone unit comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing device(s) and/or the microphone unit comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device and/or the microphone unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz.

In an embodiment, the hearing device and/or the microphone unit comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device and/or the microphone unit comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device and/or the microphone unit comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device and/or the microphone unit further comprises other relevant functionality for the application in question, e.g. compression, feedback reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

A Microphone Unit:

In an aspect, a microphone unit adapted for being located at a user and picking up a voice of the user is provided by the present disclosure. The microphone unit comprises

- a multitude M of input units $IU_i$, i=1, 2, . . . , M, each being configured for picking up or receiving a signal representative of a sound $x_i(n)$ from the environment of the microphone unit and configured to provide corresponding electric input signals $X_i(k,m)$ in a time-frequency representation in a number of frequency bands and a number of time instances, k being a frequency band index, m being a time index, n representing time, and M being larger than or equal to two; and
- a multi-input unit noise reduction system for providing an estimate $\hat{S}$ of a target signal s comprising the user's voice, the multi-input unit noise reduction system comprises a multi-input beamformer filtering unit operationally coupled to said multitude of input units $IU_i$, i=1, . . . , M, and configured to determine filter weights w(k,m) for providing a beamformed signal, wherein signal components from other directions than a direction of a target signal source are attenuated, whereas signal components from the direction of the target signal source are left un-attenuated or are attenuated less relative to signal components from said other directions; and
- antenna and transceiver circuitry for wirelessly transmitting said estimate $\hat{S}$ of the user's voice to another device wherein the multi-input beamformer filtering unit is adaptive.

It is intended that some or all of the structural features of the hearing system described above, in the 'detailed description of embodiments' or in the claims can be combined with embodiments of the microphone unit.

In an embodiment, the microphone unit comprises an attachment element, e.g. a clip or other appropriate attachment element, for attaching the microphone unit to the user.

In an embodiment, 'another device' comprises a communication device, e.g. a portable telephone, e.g. a smartphone.

In an embodiment, the multi-input beamformer filtering unit comprises an MVDR beamformer.

In an embodiment, the microphone unit is configured to receive an audio signal and/or an information signal from the other device.

Use:

In an aspect, use of a hearing system as described above, in the 'detailed description of embodiments' and in the claims, is moreover provided. In an embodiment, use is provided in binaural hearing aid systems, in handsfree telephone systems, teleconferencing systems, public address systems, classroom amplification systems, etc. In an embodiment, use to pick up a user's own voice and transmit it to a communication device, e.g. a telephone, is provided.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
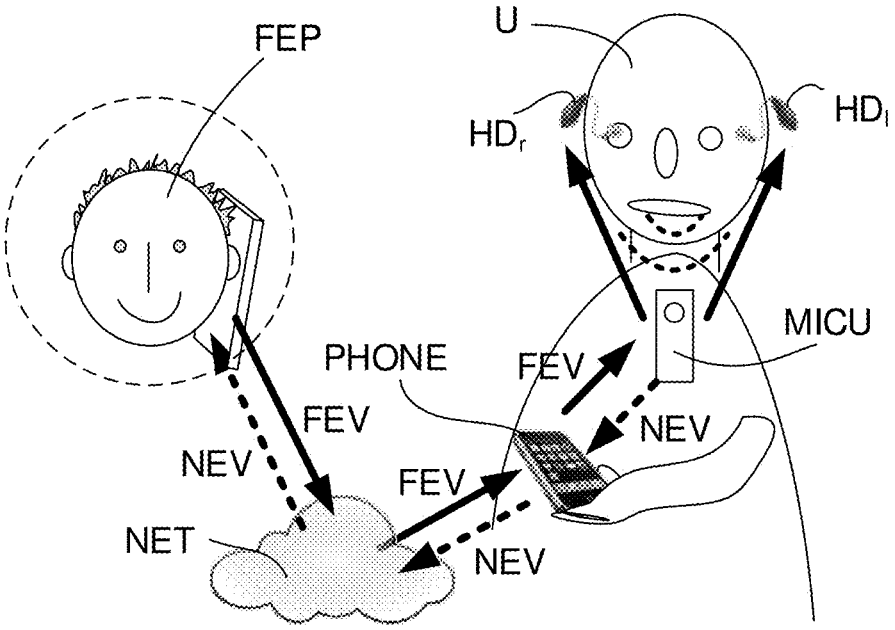
FIG. 1 shows two exemplary use scenarios of a hearing system according to the present disclosure comprising a microphone unit and a pair of hearing devices, FIG. 1A illustrating a scenario where audio signals are transmitted to the hearing devices from the telephone via the microphone unit, FIG. 1B illustrating a scenario where audio signals are transmitted to the hearing devices directly from the telephone.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing system according to the present disclosure involves building a dedicated beamformer+single-channel noise reduction (SC-NR) algorithm, as e.g. proposed in [Kjems and Jensen, 2012], which in this situation is able to adapt to the particular problem of retrieving an microphone unit users' voice signal from the noisy microphone signals, and reject/suppress any other sound source (which can be considered to be noise sources in this particular situation). FIG. 1 shows possible conceptual diagrams of such a system.

FIG. 1 shows two exemplary use scenarios of a hearing system according to the present disclosure comprising a microphone unit and a pair of hearing devices. In FIG. 1, dashed arrows (denoted NEV, near-end-voice) indicate (audio) communication from the hearing device user (U), containing the user's voice when he or she speaks or otherwise uses the voice, as picked up fully or partially by the microphone unit (MICU), to the far-end listener (FEP).

This is the situation where the proposed microphone unit noise reduction system is active. Solid arrows (denoted FEV) indicate (audio) signal transmission (far-end-voice, FEV) from the far-end talker (FEP) to the hearing device user (U) (presented via hearing aids $HD_l$, $HD_r$), this communication containing the far end person's (FEP) voice when he or she speaks or otherwise uses the voice. The communication via a 'telephone line' as illustrated in FIG. 1 is typically (but not necessarily) 'half duplex' in the sense that only the voice of one person at a time is present. The communication between the user (U) and the person (FEP) at the other end of the communication line is conducted via the user's telephone (PHONE), a network (NET), e.g. a public switched telephone network, and a telephone of the far-end-person (FEP). In the embodiments of a hearing system illustrated in FIG. 1, the user (U) is wearing a binaural haring aid system comprising left and right hearing devices (e.g. hearing aids $HD_l$, $HD_r$) at the left and right ears of the user. The left and right hearing aids ($HD_l$, $HD_r$) are preferably adapted to allow the exchange of information (e.g. control signals, and possibly audio signals, or parts thereof) between them via an interaural communication link (e.g. a link based on near-field communication, e.g. an inductive link). The user wears the microphone unit (MICU) on the chest (e.g. in a neckloop or attached to clothing by a clip of the microphone unit), appropriately positioned in distance and orientation to pick up the user's voice via built in microphones (e.g. two or more microphones, e.g. a microphone array). The user holds a telephone, e.g. a cellular telephone (e.g. a SmartPhone) in the hand. The telephone may alternatively be worn or held or positioned in any other way allowing the necessary communication to and from the telephone (e.g. around the neck, in a pocket, attached to a piece of clothing, attached to a part of the body, located in a bag, positioned on a table, etc.).

FIG. 1A illustrates a scenario where audio signals, e.g. comprising the voice (FEV) of a far-end-person (FEP), are transmitted to the hearing devices ($HD_l$, $HD_r$) from the telephone (PHONE) at the user (U) via the microphone unit (MICU). In this case, the hearing system is configure allow an audio link to be established between the microphone unit (MICU) and the left and right hearing devices ($HD_l$, $HD_r$). Specifically, the microphone unit comprises antenna and transceiver circuitry (at least) to allow the transmission of (e.g. 'far-end') audio signals (FEV) from the microphone unit to each of the left and right hearing devices. This link may e.g. be based on far-field communication, e.g. according to a standardized (e.g. Bluetooth or Bluetooth Low Energy) or proprietary scheme. Alternatively, the link may be based on near-field communication, e.g. utilizing magnetic induction.

Figure 1B:
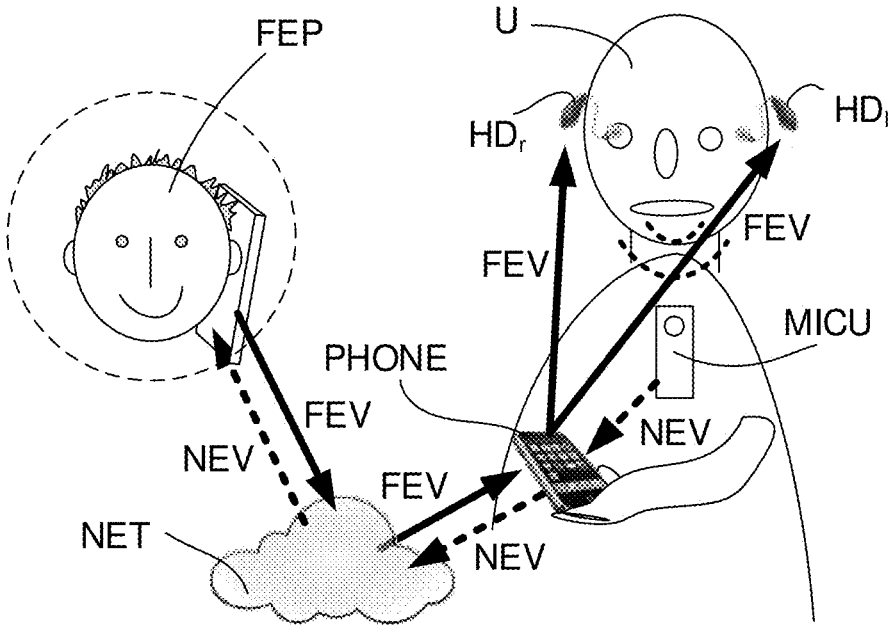

FIG. 1B illustrates a scenario where audio signals, e.g. comprising the voice (FEV) of a far-end-person (FEP), are transmitted to the hearing devices ($HD_l$, $HD_r$) directly from the telephone (PHONE) at the user (U, instead of via the microphone unit). In this case, the hearing system is configured to allow an audio link to be established between the telephone (PHONE) and the left and right hearing devices ($HD_l$, $HD_r$). Specifically, the left and right hearing devices ($HD_l$, $HD_r$) comprises antenna and transceiver circuitry to allow (at least) the reception of (e.g. 'far-end') audio signals (FEV) from the telephone (PHONE). This link may e.g. be based on far-field communication, e.g. according to a standardized (e.g. Bluetooth or Bluetooth Low Energy) or proprietary scheme.

Figure 2:
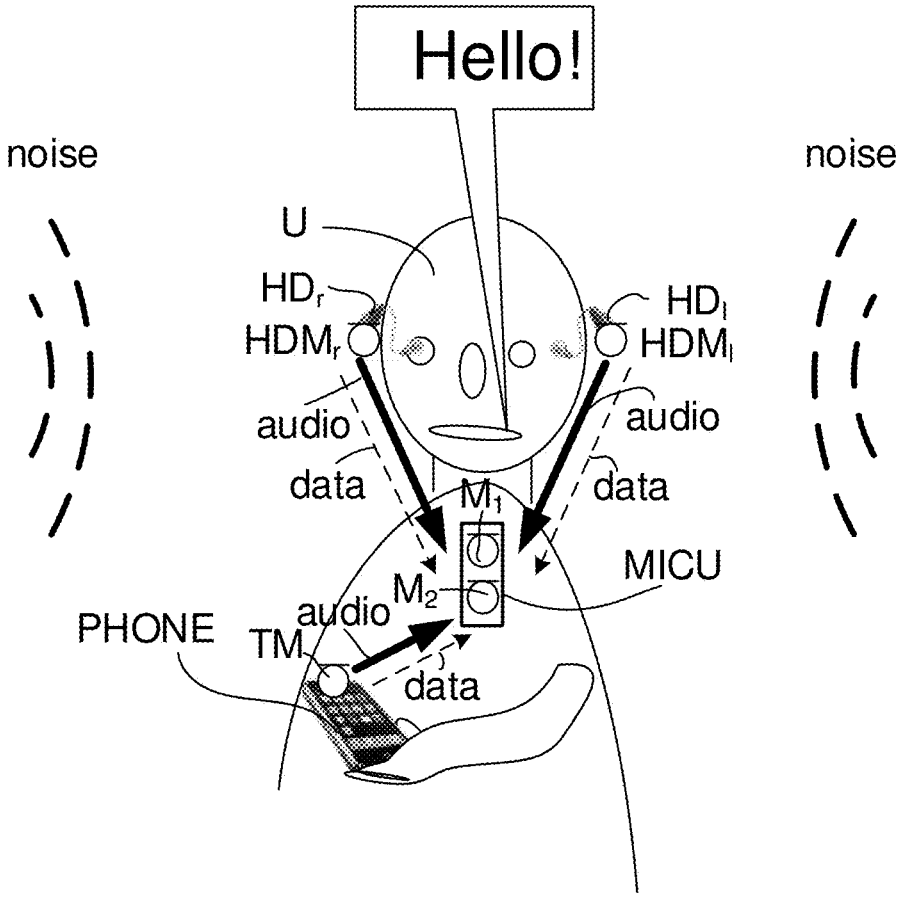
FIG. 2 shows an example of possible pickup or reception of microphone signals and possible reception of data signals from other devices in a microphone unit of a hearing system according to the present disclosure.

FIG. 2 shows an example of possible pickup or reception of microphone signals and possible reception of data signals from other devices in a microphone unit of a hearing system according to the present disclosure. FIG. 2 shows a user (U), e.g. in one of the scenarios of FIG. 1, wearing a hearing system according to the present disclosure, comprising left and right hearing devices ($HD_l$, $HD_r$) and a microphone unit (MICU) for picking up the user's voice, and a portable telephone (PHONE). The microphone unit comprises at least two microphone units ($M_1$, $M_2$) and a noise reduction system configured for picking up and enhancing (cleaning, reducing noise in) the users' voice and—e.g. in a specific communication mode of operation—transmitting the resulting signal to another device (here the telephone PHONE, cf. signal NEV in FIG. 1). Each of left and right hearing devices ($HD_l$, $HD_r$) comprises one or more microphones ($HDM_l$, $HDM_r$) for picking up sound from the environment and presenting the result to the user (U) via an output unit, e.g. a loudspeaker. In the exemplary embodiment of FIG. 2, the left and right hearing devices ($HD_l$, $HD_r$) are—e.g. in a specific communication mode of operation—configured to transmit the audio signals picked up by microphone(s) ($HDM_l$, $HDM_r$) to the microphone unit (MICU), cf. solid arrows denoted audio. Optionally, more than two, or only one (or none) of the microphone signals may be transmitted from the hearing devices to the microphone unit. Likewise, also optionally, one or more microphone signals picked up by other device(s) in the (near) environment of the user (U) may be transmitted to the microphone unit (MICU). In the example of FIG. 2, the signal picked up by a microphone (TM) of the cellular telephone (PHONE) is transmitted to the microphone unit (MICU), cf. solid arrows denoted 'audio'. The increased number of microphone signals is preferably used in a multi-microphone setup to improve the noise reduction and thus the quality of the target signal (here the user's own voice). In various embodiments, information signals may be transmitted from devices around the microphone unit to the microphone unit to improve the function of the multi-input noise reduction system (cf. FIG. 3) of the microphone unit. In an embodiment, as shown in FIG. 2, such data signals may be exchanged between (e.g. transmitted from) the telephone (PHONE) and/or one or both of the hearing devices ($HD_l$, $HD_r$) and the microphone unit, cf. dashed (thin) arrows denoted 'data'. Depending on the mode of operation of the hearing system, the information (data) may e.g. comprise estimates of background noise (e.g. 'noise' in FIG. 2) and/or voice activity by the user and/or a far-end-person of a current telephone communication, etc.

Figure 3:
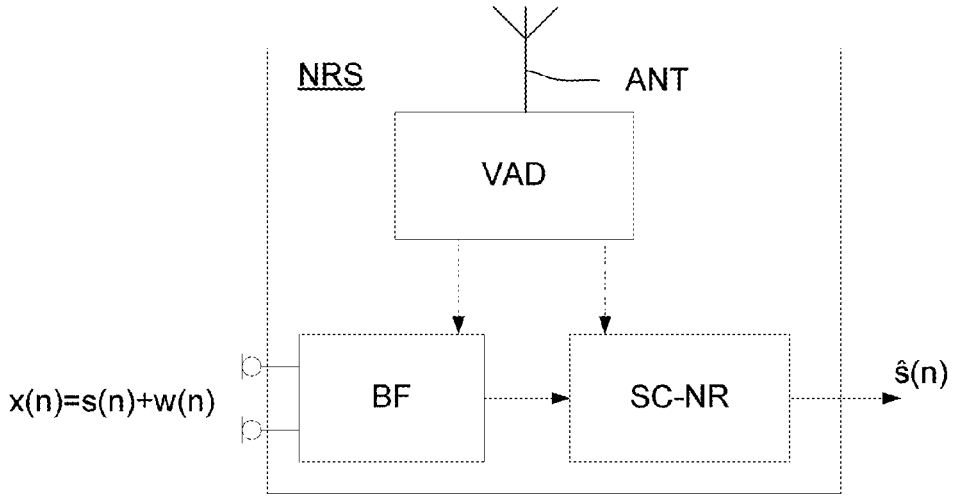
FIG. 3 shows a block diagram of a multi-input beamformer-noise reduction system of a microphone unit according to the present disclosure.

FIG. 3 shows a block diagram of a multi-input beamformer-noise reduction system (denoted NRS in FIGS. 3 and 4) of a microphone unit according to the present disclosure. FIG. 3 illustrates an adaptive beamformer (BF)-single-channel noise reduction (SC-NR) system. The beamformer (BF) is adaptive in two ways as described in the following. Firstly, when the user is silent, as e.g. detected by a voice activity detector (VAD) algorithm in the microphone unit (or the hearing device, or another device, cf. optional connection via antenna and transceiver circuitry indicated in FIG. 3 by symbol ANT), e.g. based on voice activity from the far-end speaker, which is easily detected in the microphone unit (or in the hearing device or in the telephone). In such situation, inter-microphone noise covariance matrices may be updated to adapt the shape of the beam-pattern to allow for maximum spatial noise reduction. Secondly, when the user speaks, the beamformers' spatial direction (technically, represented by the so-called look-vector, d), is updated. This adaptation compensates for variation in position of the microphone unit (across time and from user to user) and for differences in physical characteristics (e.g., head and shoulder characteristics) of the user (U) of the microphone unit (MICU). Beamformer designs exist which are independent of the exact microphone locations, in the sense that they aim at retrieving the own-voice target signal in a minimum mean-square sense or in a minimum-variance distortionless response sense independent of the microphone geometry. In other words, the beamformer "does the best job possible" for any microphone configuration, but some microphone locations are obviously better than other.

Furthermore, the SC-NR system (which may or may not be present), is adaptive to the level of the residual noise in the beamformer output (Y in FIG. 4); for acoustic situations, where the beamformer already rejected much of the ambient noise (due to its spatial filtering), the SNR in the beamformer output is already significantly improved, and the SC-NR system may be essentially transparent. However, in other situations, where a significant amount of residual noise is present in the beamformer output, the SC-NR system may suppress time-frequency regions of the signal, where the SNR is low, to improve the quality of the voice signal to be transmitted via the communication device (e.g. a mobile phone) to the far-end listener.

Before use, default beamformer weights are preferably determined in an offline calibration process, e.g. conducted in a sound studio with a head-and-torso-simulator (HATS, Head and Torso Simulator 4128C from Brüel & Kjær Sound & Vibration Measurement A/S) with play-back of voice signals from the dummy head's mouth, and a microphone unit mounted in a default position on the "chest" of the dummy head. In this way, e.g., (default) optimal minimum-variance distortion-less response (MVDR) beamformer weights may be found, which are hardwired in, e.g. stored in a memory of, the microphone unit, cf. e.g. [Kjems and Jensen; 2012].

The adaptive beamformer-single-channel noise reduction (SC-NR) system allows a departure from the default beamformer weights, to take into account differences between the actual situation (with a real human user in a real (not acoustically ideal) room and a potentially with casual position of the microphone unit relative to the user's mouth) and the default situation (with the dummy in the sound studio and an ideally positioned microphone unit).

The adaptation process may be monitored by comparing the adapted beamformer weights with the default weights, and potentially constrain the adapted beamformer weights if these differ too much from the default weights.

Figure 4:
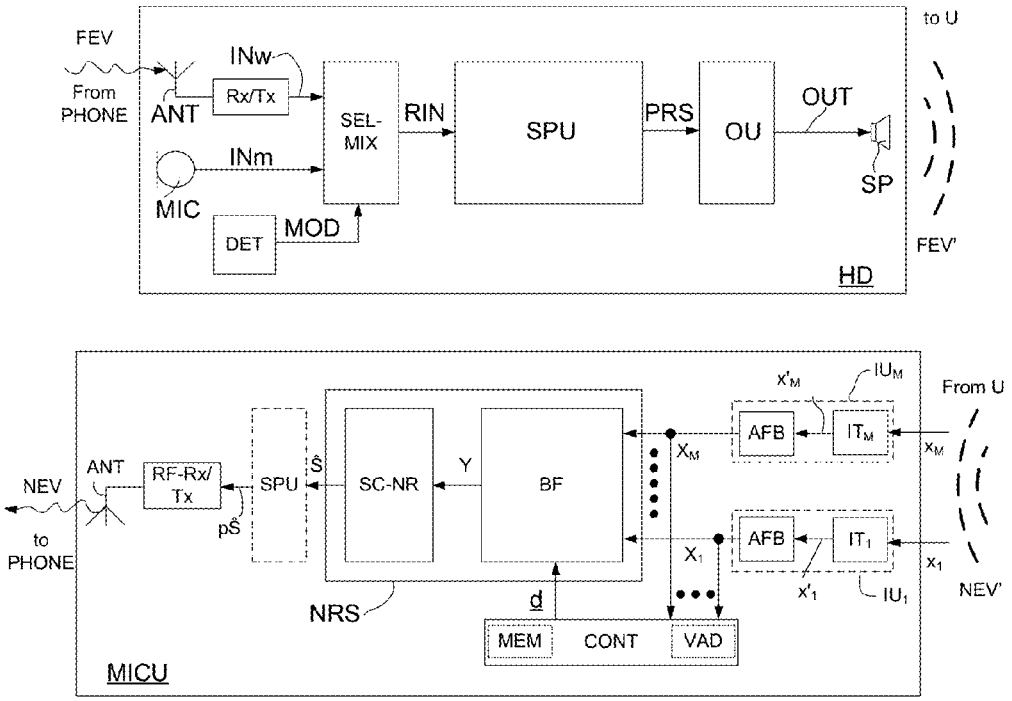
FIG. 4 shows an exemplary block diagram of an embodiment of a hearing system according to the present disclosure comprising a microphone unit and a hearing device.

FIG. 4 shows an exemplary block diagram of an embodiment of a hearing system according to the present disclosure comprising a microphone unit and a hearing device. FIG. 4 shows a hearing system comprising a hearing device (HD) adapted for being located at or in an ear of a user, or adapted for being fully or partially implanted in the head of the user, and a separate microphone unit (MICU) adapted for being located at said user and picking up a voice of the user. The microphone unit (MICU) comprises a multitude M of input units $IU_i$, i=1, 2, . . . , M, each being configured for picking up or receiving a signal $x_i$ (i=1, 2, . . . , M) representative of a sound NEV' from the environment of the microphone unit (ideally from the user U, cf. reference From U in FIG. 4) and configured to provide corresponding electric input signals $X_i$ in a time-frequency representation in a number of frequency bands and a number of time instances. M is larger than or equal to two. In the embodiment of FIG. 4, input units $IU_1$ and $IU_M$ are shown to comprise respective input transducers $IT_1$ and $IT_M$ (e.g. microphones) for converting input sound $x_1$ and $x_M$ to respective (e.g. digitized) electric input signals $x'_1$ and $x'_M$ and each their filterbanks (AFB) for converting electric (time-domain) input signals $x'_1$ and $x'_M$ to respective electric input signals $X_1$ and $X_M$ in a time-frequency representation (k,m). All M input units may be identical to $IU_1$ and $IU_M$ or may be individualized, e.g. to comprise individual normalization or equalization filters and/or wired or wireless transceivers. In an embodiment, one or more of the input units comprises a wired or wireless transceiver configured to receive an audio signal from another device, allowing to provide inputs from input transducers spatially separated from the microphone unit, e.g. from one or more microphones of one or more hearing devices (HD) of the user (cf. e.g. FIG. 2). The time-frequency domain input signals ($X_i$, i=1, 2, . . . , M) are fed to a control unit (CONT) and to a multi-input unit noise reduction system (NRS) for providing an estimate $\hat{S}$ of a target signal s comprising the user's voice. The multi-input unit noise reduction system (NRS) comprises a multi-input beamformer filtering unit (BF) operationally coupled to said multitude of input units $IU_i$, i=1, . . . , M, and configured to determine filter weights w(k,m) for providing a beamformed signal Y, wherein signal components from other directions than a direction of a target signal source (the user's voice) are attenuated, whereas signal components from the direction of the target signal source are left un-attenuated or are attenuated less relative to signal components from other directions. The multi-channel noise reduction system (NRS) of the embodiment of FIG. 4 further comprises a single channel noise reduction unit (SC-NR) operationally coupled to the beamformer filtering unit (BF) and configured for reducing residual noise in the beamformed signal Y and providing the estimate $\hat{S}$ of the target signal (the user's voice). The microphone unit may further comprise a signal processing unit (SPU) for further processing the estimate $\hat{S}$ of the target signal and provide a further processed signal $p\hat{S}$. The microphone unit further comprises antenna and transceiver circuitry ANT, RF-Rx/Tx) for transmitting said estimate $\hat{S}$ (or further processed signal $p\hat{S}$) of the user's voice to another device, e.g. a communication device (her indicated by reference 'to Phone', essentially comprising signal NEV, near-end-voice).

The microphone unit further comprises a control unit (CONT) configured to provide that the multi-input beamformer filtering unit is adaptive. The control unit (CONT) comprises a memory (MEM) storing reference values of a look vector (d) of the beamformer (and possibly also reference values of the noise-covariance matrices). The control unit (CONT) further comprises a voice activity detector (VAD) and/or is adapted to receive information (estimates) about current voice activity of the user and or the fare end person currently engaged in a telephone conversation with the user. Voice activity information is used to control the timing of the update of the noise reduction system and hence to provide adaptivity.

The hearing device (HD) comprises an input transducer, e.g. microphone (MIC), for converting an input sound to an electric input signal INm. The hearing device may comprise a directional microphone system (e.g. a multi-input beamformer and noise reduction system as discussed in connection with the microphone unit, not shown in the embodiment of FIG. 4) adapted to enhance a target acoustic source in the user's environment among a multitude of acoustic sources in the local environment of the user wearing the hearing device (HD). Such target signal (for the hearing device) is typically NOT the user's own voice, but may—in a specific communication mode of operation—be the user's own voice. In such case that microphone signal INm may be transmitted to another device, e.g. the microphone unit (MICU). The hearing device (HD) further comprises an antenna (ANT)

and transceiver circuitry (Rx/Tx) for wirelessly receiving a direct electric input signal from another device, e.g. a communication device, here indicated by reference 'From PHONE' and signal FEV (far-end-voice) referring to the telephone conversation scenarios of FIG. 1. The transceiver circuitry comprises appropriate demodulation circuitry for demodulating the received direct electric input to provide the direct electric input signal INw representing an audio signal (and/or a control signal). The hearing device (HD) further comprises a selection and/or mixing unit (SEL-MIX) allowing to select one of the electric input signals (INw, INm) or to provide an appropriate mixture as a resulting input signal RIN. The selection and/or mixing unit (SEL-MIX) is controlled by detection and control unit (DET) via signal MOD determining a mode of operation of the hearing device (in particular controlling the SEL-MIX-unit). The detection and control unit (DET), may e.g. comprise a detector for identifying the mode of operation (e.g. for detecting that the user is engaged or wish to engage in a telephone conversation) or is configured to receive such information, e.g. from an external sensor and/or from a user interface.

The hearing device comprises a signal processing unit (SPU) for processing the resulting input signal RIN and is e.g. adapted to provide a frequency dependent gain and/or a level dependent compression and/or a transposition (with or without frequency compression) of one or frequency ranges to one or more other frequency ranges, e.g. to compensate for a hearing impairment of a user. The signal processing unit (SPU) provides a processed signal PRS. The hearing device further comprises an output unit for providing a stimulus OUT configured to be perceived by the user as an acoustic signal based on a processed electric signal PRS. In the embodiment of FIG. 4, the output transducer comprises a loudspeaker (SP) for providing the stimulus OUT as an acoustic signal to the user (here indicated by reference 'to U' and signal FEV' (far-end-voice) referring to the telephone conversation scenarios of FIG. 1. The hearing device may alternatively or additionally comprise a number of electrodes of a cochlear implant or a vibrator of a bone conducting hearing device.

The embodiment of FIG. 4 may e.g. exemplify a 'near-end' part of the scenario of FIG. 1B.

Figure 5:
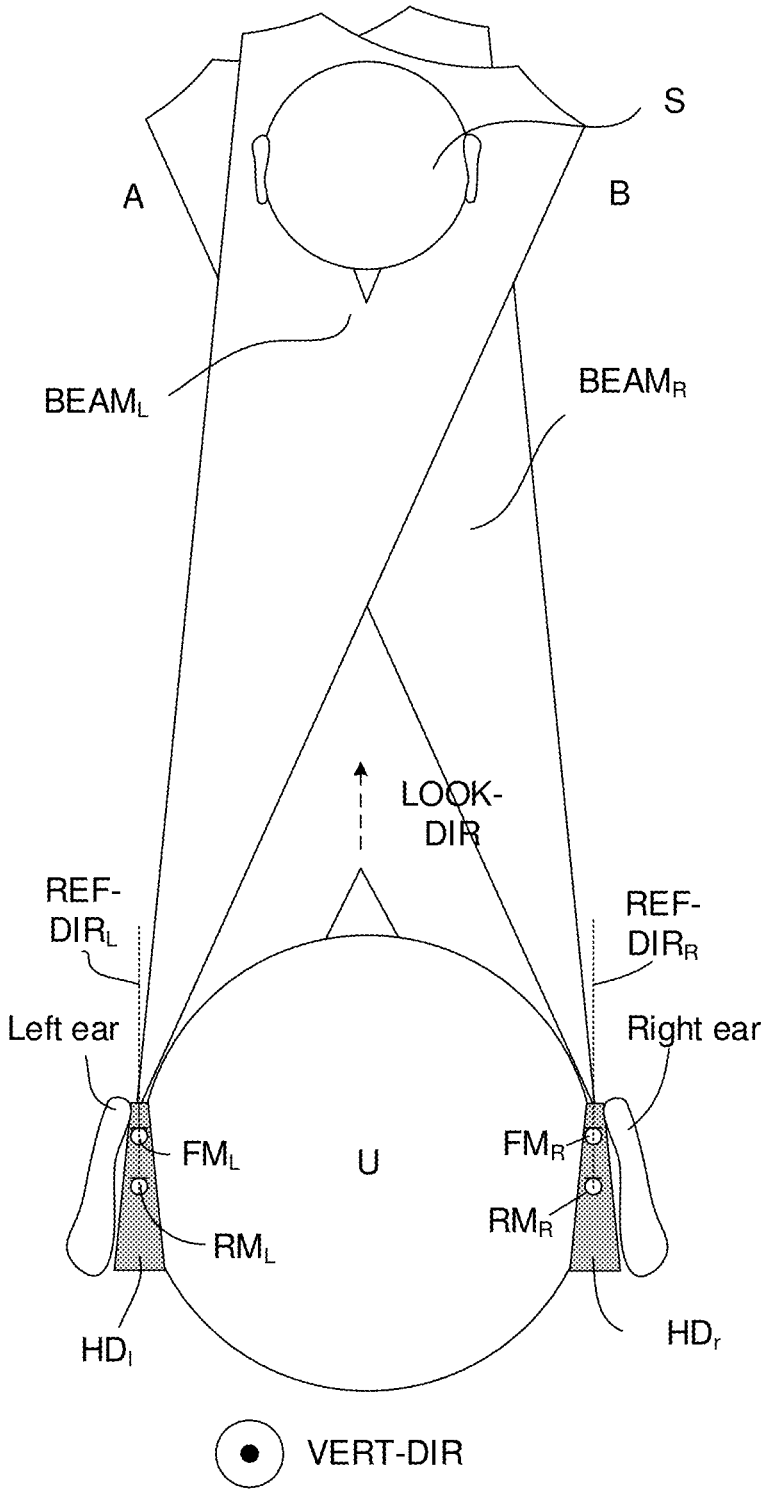
FIG. 5 illustrates a normal configuration of a binaural hearing system comprising left and right hearing devices with a binaural beamformer focusing on a target sound source in front of the user.

FIG. 5 illustrates a normal configuration of a binaural hearing system comprising left and right hearing devices ($HD_l$, $HD_r$) with a binaural beamformer focusing on a target sound source (speaker, S) in front of the user (U). The acoustic situation schematically illustrated by FIG. 5 is a user (U) listening to a speaker (S) in front of the user (here shown in a direction of attention, a look direction (LOOK-DIR), of the user (U)). The user is equipped with left and right hearing devices ($HD_l$ and $HD_r$) located at the left (Left ear) and right ears (Right ear), respectively, of the user. The left and right hearing devices each comprises at least two input units for providing first and second electric input signals representing first and second sound signals from the environment of the binaural hearing system, and a beamformer filtering unit for generating a beamformed signal from the first and second electric input signals. In the embodiments of FIG. 5, the first and second input units are implemented by front ($FM_L$, $FM_R$) and rear ($RM_L$, $RM_R$) microphones, in the left and right hearing devices, respectively, 'front' and 'rear' being defined relative to the look direction of the user (and assuming that the hearing devices are correctly mounted). The front ($FM_L$, $FM_R$) and rear ($RM_L$, $RM_R$) microphones of the left and right hearing devices, respectively, constitute respective microphone systems, which together with respective configurable beamformer units allow each hearing device to maximize the sensitivity of the microphone system (cf. schematic beams $BEAM_L$ and $BEAM_R$, respectively) in a specific direction relative to the hearing device in question (REF-$DIR_L$, REF-$DIR_R$, respectively, e.g. equal to the look direction (LOOK-DIR) of the user, assuming that the hearing devices are correctly mounted). The view of FIGS. 1A and 1B is intended to represent a horizontal cross-sectional view perpendicular to the surface on which the two persons A and B and the user U are standing (or otherwise located), as indicated by the symbol denoted VERT-DIR intended to indicate a vertical direction with respect to said surface (e.g. of the earth).

Figure 6A:
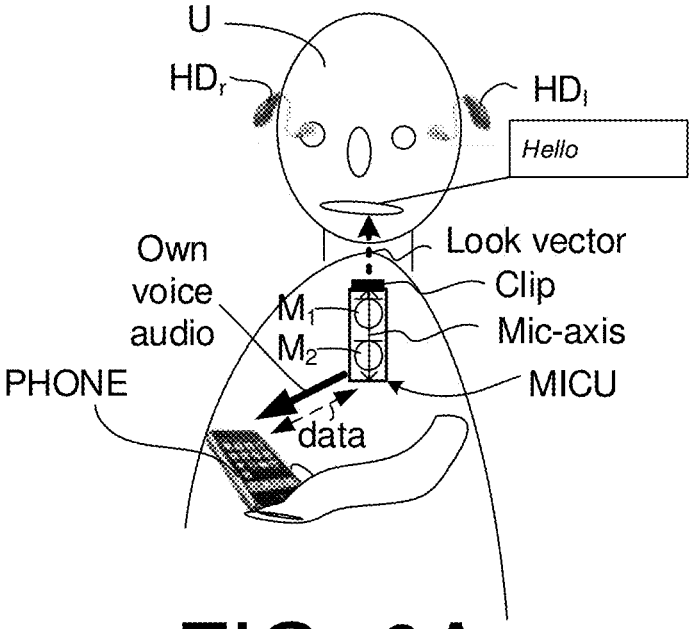
FIG. 6A shows a first location and orientation of a microphone unit on a user.
Figure 6B:
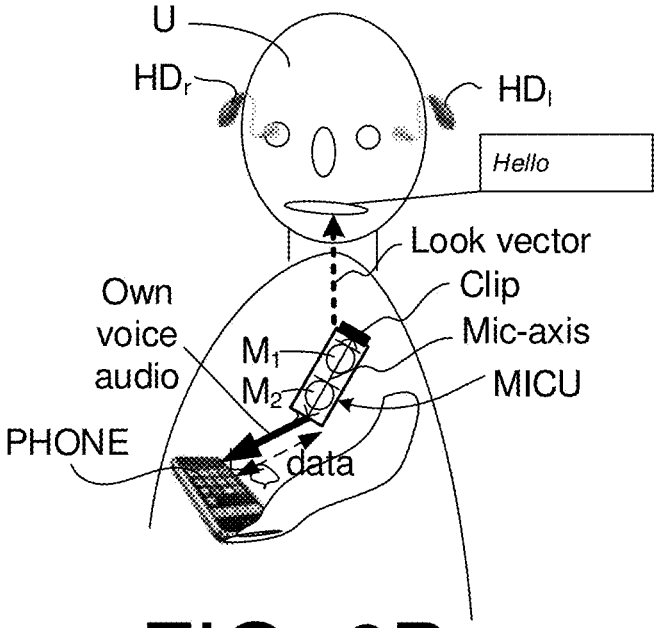
FIG. 6B shows a second location and orientation of a microphone unit on a user.

FIGS. 6A and 6B illustrate two different locations and orientations of a microphone unit on a user. The sketches are intended to illustrate that the microphone unit (MICU) may be attached to a variable surface (e.g. clothes, e.g. on the chest, etc.) of the user (U), so that the position/direction of the microphone unit (MICU) relative to the user's mouth may change over time. As a consequence the beamformer-noise reduction should preferably be adaptive to such changes as described in the present disclosure. With reference to FIG. 1A, FIG. 6A, 6B show a user wearing a pair of hearing aids ($HD_l$, $HD_r$) and having a microphone unit (MICU) attached to the body below the head, e.g. via an attachment element, e.g. a clip (Clip). A look vector (Look vector) from the microphone unit to the target sound source as (the user's mouth) well as a microphone axis (Mic-axis) of the two microphones (M1, M2) are indicated in the two embodiments. FIG. 6A may represent a (predefined) reference location of the microphone unit for which a predetermined look vector (and possibly inter-microphone covariance matrix) has been determined. FIG. 6B may illustrate a location of the microphone unit for which deviating from the reference location. The look vector ($\underline{d}(k,m)$, Look vector) is in this case a 2-dimensional vector comprising elements ($d_1$, $d_2$) defining an acoustic transfer function from the target signal source (Hello, the mouth of the user, U) to the microphones (M1, M2) of the microphone unit (MICU) (or the relative acoustic transfer function from the one of the microphones to the other, defined as a reference microphone). Hence, in the scenario of FIG. 6B, the adaptive beamformer filtering unit has to provide or use an update of the look vector (at least, and preferably also the noise power estimates). Such adaptive update of the beamformer weights is described in the present disclosure and further detailed out in [Kjems and Jensen; 2012].

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coup led" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Kjems and Jensen; 2012] U. Kjems, J. Jensen, "Maximum likelihood based noise covariance matrix estimation for multi-microphone speech enhancement", 20th European Signal Processing Conference (EUSIPCO 2012), pp. 295-299, 2012.

The invention claimed is:

1. A hearing system comprising:

a hearing device adapted for being located at or in an ear of a user, or adapted for being fully or partially implanted in the head of the user, the hearing device being adapted to provide a frequency dependent gain, and/or a level dependent compression, and/or a transposition of one or more frequency ranges to one or more other frequency ranges, to compensate for a hearing impairment of the user; and a separate microphone unit adapted for being located at said user and picking up a voice of the user when the user wears the hearing system, wherein the separate microphone unit comprises a multitude M of input units $IU_i$, i=1, 2, . . . , M, each being configured for picking up or receiving a signal representative of a sound $x_i(n)$ from the environment of the microphone unit and configured to provide corresponding electric input signals $X_i(k,m)$ in a time-frequency representation in a number of frequency bands and a number of time instances, k being a frequency band index, m being a time index, n representing time, and M being larger than or equal to two; and a multi-input unit noise reduction system for providing an estimate $\hat{S}$ of a target signal s comprising the user's voice, the multi-input unit noise reduction system comprises a multi-input beamformer filtering unit operationally coupled to said multitude of input units $IU_i$, i=1, . . . , M, and configured to determine filter weights w(k,m) for providing a beamformed signal, wherein signal components from other directions than a direction of a target signal source are attenuated, whereas signal components from the direction of the target signal source are left unattenuated or are attenuated less relative to signal components from said other directions; and antenna and transceiver circuitry for transmitting said estimate $\hat{S}$ of the user's voice to another device; and wherein the multi-input beamformer filtering unit is adaptive.

2. A hearing system according to claim 1 wherein another device comprises a communication device, e.g. a telephone.

3. A hearing system according to claim 1 wherein the hearing device and the microphone unit each comprising respective antenna and transceiver circuitry for establishing a wireless audio link between them.

4. A hearing system according to claim 1 wherein the microphone unit comprises a voice activity detector for estimating whether or not the user's voice is present or with which probability the user's voice is present in the current environment sound, or is configured to receive such estimates from another device.

5. A hearing system according to claim 4 configured to estimate a noise power spectral density of disturbing background noise when the user's voice is not present or is present with probability below a predefined level, or to receive such estimate from another device.

6. A hearing system according to claim 1 comprising a memory comprising a predefined reference look vector defining a spatial direction from the microphone unit to the target sound source.

7. A hearing system according to claim 1 wherein the multi-input unit noise reduction system is configured to update a look vector when the user's voice is present or present with a probability larger than a predefined value.

8. A hearing system according to claim 7 configured to limit said update of the look vector by comparing update beamformer weights corresponding to an update look vector with default weights corresponding to the reference look vector, and to constrain or neglect the update beamformer weights if these differ from the default weights with more than a predefined absolute or relative amount.

9. A hearing system according to claim 1 comprising a memory comprising predefined reference inter-input unit noise covariance matrices of the microphone unit.

10. A hearing system according to claim 9 configured to control the update of the noise power spectral density of disturbing background noise by comparing currently determined inter-input unit noise covariance matrices with the reference inter-input unit noise covariance matrices, and to constrain or neglect the update of the noise power spectral density of disturbing background noise if the currently determined inter-input noise covariance matrices differ from the reference inter-inter input noise covariance matrices by more than a predefined absolute or relative amount.

11. A hearing system according to claim 1 wherein the multi-channel noise reduction system comprises a single channel noise reduction unit operationally coupled to the beamformer filtering unit and configured for reducing residual noise in the beamformed signal and providing the estimate $\hat{S}$ of the target signal s.

12. A hearing system according to claim 1 wherein the microphone unit comprises at least three input units, wherein at least two of the input units each comprises a microphone, and wherein at least one of the input units comprises a receiver for directly receiving an electric input signal representative of a sound from the environment of the microphone unit.

13. A hearing system according to claim 1 wherein the microphone unit is configured to receive an audio signal and/or an information signal from the other device.

14. A hearing system according to claim 1 wherein the microphone unit is configured to receive an estimate of far-end voice activity from a voice activity detector located in a communication device or in the hearing device.

15. A microphone unit adapted for being located at a user and picking up a voice of the user when said user wears the microphone unit, the microphone unit comprising a multitude M of input units $IU_i$, i=1, 2, . . . , M, each being configured for picking up or receiving a signal representative of a sound $x_i(n)$ from the environment of the microphone unit and configured to provide corresponding electric input signals $X_i(k,m)$ in a time-frequency representation in a number of frequency bands and a number of time instances, k being a frequency band index, m being a time index, n representing time, and M being larger than or equal to two; and a multi-input unit noise reduction system for providing an estimate $\hat{S}$ of a target signal s comprising the user's voice, the multi-input unit noise reduction system comprises a multi-input beamformer filtering unit operationally coupled to said multitude of input units $IU_i$, i=1, . . . , M, and configured to determine filter weights w(k,m) for providing a beamformed signal, wherein signal components from other directions than a direction of a target signal source are attenuated, whereas signal components from the direction of the target signal source are left un-attenuated or are attenuated less relative to signal components from said other directions; and antenna and transceiver circuitry for wirelessly transmitting said estimate $\hat{S}$ of the user's voice to another device wherein the multi-input beamformer filtering unit is adaptive.

16. A microphone unit according to claim 15 comprising an attachment element for attaching said microphone unit to the user.

17. A microphone unit according to claim 15 wherein another device comprises a communication device, e.g. a portable telephone.

18. A microphone unit according to claim 15 wherein the multi-input beamformer filtering unit comprises an MVDR beamformer.

19. A microphone unit according to claim 15 wherein the microphone unit is configured to receive an audio signal and/or an information signal from the other device.

20. A hearing system according to claim 1, wherein the hearing device comprises a hearing aid.

21. A hearing system according to claim 1 wherein the hearing device comprises a voice activity detector configured to provide an estimate of voice activity in the current environment sound, and wherein the hearing system is configured to transmit the estimate of voice activity to the microphone unit from the hearing device.

22. A hearing system according to claim 1 wherein the microphone unit is configured to receive an audio signal and/or an information signal from the hearing device.

23. A microphone unit according to claim 15 configured to receive an audio signal and/or an information signal from the hearing device.

* * * * *